US010835090B2

(12) United States Patent
Payziev et al.

(10) Patent No.: US 10,835,090 B2
(45) Date of Patent: Nov. 17, 2020

(54) TOILET VENTILATION SYSTEM

(71) Applicants: Abdulaziz Payziev, Nashville, TN (US); Akmal Payziev, Nashville, TN (US)

(72) Inventors: Abdulaziz Payziev, Nashville, TN (US); Akmal Payziev, Nashville, TN (US)

( * ) Notice: Subject to any disclaimer, the term of this patent is extended or adjusted under 35 U.S.C. 154(b) by 0 days.

(21) Appl. No.: 14/719,399

(22) Filed: May 22, 2015

(65) Prior Publication Data

US 2016/0338556 A1 Nov. 24, 2016

(51) Int. Cl.
*A47K 13/30* (2006.01)
*E03D 9/05* (2006.01)

(52) U.S. Cl.
CPC ..... *A47K 13/307* (2013.01); *E03D 9/05* (2013.01)

(58) Field of Classification Search
USPC ..... 4/213
See application file for complete search history.

(56) References Cited

U.S. PATENT DOCUMENTS 3,887,949 A * 6/1975 Osmond ..... A47K 13/307 4/209 R
4,586,201 A * 5/1986 Todd, Jr. ..... E03D 9/052 4/213
5,355,536 A 10/1994 Prisco
5,539,937 A * 7/1996 Barefoot ..... E03D 9/052 4/213
5,829,066 A * 11/1998 Aibe ..... E03D 9/052 4/213
6,260,215 B1 7/2001 Miller
6,546,567 B2 4/2003 Kuzniar
6,795,980 B1 9/2004 Ries
7,921,477 B2 4/2011 Casale
8,069,501 B2 12/2011 Casson et al.
2011/0099697 A1 5/2011 Weigart
2012/0023650 A1 2/2012 Azodi
2012/0227167 A1 9/2012 Ineson et al.
(Continued)

FOREIGN PATENT DOCUMENTS

CN 2458371 11/2001
CN 264252 10/2004
CN 201045212 4/2008
(Continued)

OTHER PUBLICATIONS

International Search and Opinion, Patent Cooperation Treaty, dated Jul. 30, 2015, pp. 1-10, European Patent Office.
(Continued)

*Primary Examiner* — Lauren A Crane
(74) *Attorney, Agent, or Firm* — Bradley Arant Boult Cummings; Timothy L. Capria

(57) ABSTRACT

A toilet bowl ventilation system exhausts air in and around the toilet bowl to an area adjacent to the room in which the toilet is located. The toilet bowl ventilation system includes a housing operable to affix to a toilet seat and a fan positioned within the housing. The system further includes a controller for activating the fan and optionally adjusting the fan's speed when activated. An exhaust hose is operable to transport air from the fan in the housing to a selected area adjacent to the room in which the toilet is located (e.g., outdoors).

20 Claims, 8 Drawing Sheets

(56) References Cited

U.S. PATENT DOCUMENTS

2013/0097770 A1* 4/2013 Gallardo ..... A47K 17/00
4/213

FOREIGN PATENT DOCUMENTS

| | | |
|---|---|---|
| CN | 201195870 | 1/2009 |
| EP | 0289696 | 11/1988 |
| JP | S6193576 | 6/1986 |
| JP | 2008081928 | 4/2008 |
| JP | 2010227360 | 10/2010 |
| JP | 2013064235 | 4/2013 |
| JP | 2013192765 A | 9/2019 |
| WO | 2014024522 | 2/2014 |

OTHER PUBLICATIONS

EP Application No. 15729618.7, Communication pursuant to Article 94(c) EPC (dated Mar. 21, 2018).
EP Application No. 15729618.7, Summons to Attend Oral Proceedings pursuant to Rule 1151(1) EPC (Nov. 15, 2018).
EP Application No. 15729618.7, Communication under Rule 71(3), Intention to Grant (dated Mar. 8, 2019).

* cited by examiner

TOILET VENTILATION SYSTEM

CROSS-REFERENCES TO RELATED APPLICATIONS

This application claims priority to and hereby incorporates by reference in its entirety U.S. Provisional Patent Application No. 62/001,917 entitled "TOILET VENTILATION SYSTEM" filed on May 22, 2014.

TECHNICAL FIELD

The present disclosure relates to a toilet ventilation system to vent air from around a toilet bowl. More specifically, the disclosure is directed to a toilet ventilation system including a housing, a fan enclosed by the housing, an air vent in the housing in proximity to a toilet bowl, and an ventilation outlet to move air from the area proximate to the toilet bowl through the housing and exhaust the air to an adjacent area.

BACKGROUND OF THE INVENTION

The disclosure relates to the field of restroom ventilation devices, and specifically to those devices mounted on or proximate to a toilet bowl.

Within the field of restroom ventilation devices, a distinct need exists for an apparatus which may efficiently exhaust the unpleasant odors and air which normally emanate from a toilet, especially during and after use. Furthermore, a need exists for an apparatus which may be quickly and easily adapted onto a number of existing toilets.

Numerous systems are known for exhausting air from a restroom. Systems which are mounted within a wall or ceiling are the most common. However, these known systems suffer from significant inefficiencies. Chief among these inefficiencies is the excessive room volume from which wall and ceiling-mounted systems must ventilate. The primary volume of concern exists at, or near, the toilet itself. However, wall and ceiling-mounted systems must draw air from the entire room, including area occupying the space at and near the toilet.

Because of the large volume of air that known systems would need to ventilate to be effective, known restroom ventilation systems fail to remove all air containing foul odors, thereby allowing foul odors to linger or permeate the room. In order to be effective, traditional restroom ventilation systems require the ventilation of large quantities of air. To ventilate an effective amount of air to remove offensive odors rapidly, the speed and size of the room fan must be significant. Even then, the opportunities for pressure loss and air-flow resistance naturally increase with the size of the room such that the inefficiencies associated with ventilating large restrooms, including commercial restrooms, may be significantly multiplied over those existing in an average-sized residential restroom.

Additionally, removing air from the room does not prevent the user from being exposed to unpleasant smells or prevent users in adjacent stalls from being exposed to unpleasant smells emitted by a toilet associated with another user. Moreover, existing restroom ventilation systems are not energy efficient, because they may increase the amount of conditioned air that needs to be supplied to the restroom by heating, ventilating and cooling systems. Furthermore, because of the large room size and small air draw, the time to remove unpleasant odors from the toilet area may overlap between users, exposing a subsequent user to a prior user's odors.

Several toilet-mounted ventilation systems currently exist. However, these systems require proprietary toilets or proprietary seat arrangements. A consumer desiring to install an existing toilet-mounted ventilation system must replace the existing toilet and buy a toilet that is compatible with that specific toilet-mounted ventilation system. Even if a consumer does purchase a known toilet-mounted ventilation system, the consumer is required to replace and use only the proprietary seats designed and produced to work with that system. The lack of compatibility and interoperability between various toilet models and toilet-mounted ventilation systems greatly limits consumer choices for selecting toilet and toilet seat color, design, and features. Moreover, the lack of compatibility and interoperability are also likely to increase toilet seat and toilet part replacement cost should a seat, a toilet, or any other part of the seat or toilet, need to be replaced.

Beyond the disadvantages of a proprietary seat arrangement, incorporating ventilation structures necessarily introduces design constraints on the seat. Also, users will likely face difficulty when trying to clean the complex duct arrangements formed within the seats of the prior art. Since the seats are so closely positioned to the toilet bowl itself, cleaning the seats is especially important in preventing the spread of germs and disease, and in maintaining a clean appearance.

Toilet-mounted ventilation systems of the prior art also fail to teach systems which fully eliminate odors. Prior art systems simply recirculate air and odors drawn from a toilet back into the room. Filters, such as those made from activated charcoal, are placed in the air-flow path and serve to remove some of the odors before the air is blown back into the room. However, filters, such as those made from activated charcoal, are usually only able to remove up to 70% of the odors found in the air and become saturated over time, which results in a reduction in efficiency. Moreover, filters require replacement at the end of their useful life.

BRIEF SUMMARY OF THE INVENTION

In view of the foregoing, a toilet ventilation system that is efficient, effective, easy to clean, and compatible with existing toilets is needed.

An embodiment disclosed herein is a toilet bowl ventilation system. The ventilation system includes a housing connecting a toilet seat associated with the toilet bowl, the housing having a ventilation inlet in a bottom surface of the housing. The ventilation system includes a ventilation outlet and a fan positioned within the housing operable to move air from the ventilation inlet through the housing to the ventilation outlet in response to receiving power. A controller selectively provides power to the fan.

Another embodiment disclosed herein is a ventilated toilet seat base. The ventilated toilet seat base includes an aperture and a base hingedly connected to the toilet seat, the base including a lower distal vent portion and configured to be received on a toilet. The seat base includes an exhaust fan at least partially enclosed in the base, the exhaust fan in fluid communication with the lower vent portion and configured to draw air from the lower vent portion to the exhaust fan. An outlet is in fluid communication with the exhaust fan and is configured to receive air from the exhaust fan. A controller selectively provides power to the fan.

A sensor may be positioned in the toilet seat to provide an activation signal to the controller indicative of a presence of a body on the toilet seat, wherein the controller is operable to provide power to the fan when the activation signal indicates that the body is present on the toilet seat. In an embodiment, the sensor is operable to provide an activation signal to the controller indicative of a presence of a body on the toilet seat, and the controller is operable to provide power to the fan when the activation signal indicates that the body is present on the toilet seat.

The housing may also include a lower distal vent portion including at least one ventilation inlet.

The toilet bowl ventilation system may also include an exhaust hose operable to fluidly connect the ventilation outlet of the housing to an adjacent area. The adjacent area may comprise an exhaust tube or an exhaust pipe. In an embodiment, the system includes a hose or a tube in fluid communication with the ventilation outlet and configured to receive air from the ventilation outlet.

In an embodiment, the system includes a closing mechanism operable to control a speed at which the toilet seat travels towards a rim of the toilet bowl when transitioning the seat from an opened position to a closed position. In another embodiment, the system also includes a seat cover hingedly attached to the housing and the toilet seat. The toilet cover may include an upwardly tapered seat cover top.

The toilet bowl ventilation system may include a fan cover operable to at least partially enclose the fan, and have a top and a sidewall. The fan outlet may be positioned in the fan cover sidewall, an inlet cover may be positioned underneath the fan. The inlet cover may prevent water from being pulled into the fan. In an embodiment, the fan cover fully encloses the fan.

In an embodiment, a seat cover may be positioned on the toilet seat and hingedly attached to the base. The seat cover may have a distal seat cover height and a proximal seat cover height, the proximal height greater than the distal height.

In another embodiment, the toilet seat includes an aperture sidewall and a bottom surface, and neither the aperture sidewall nor the bottom surface includes a vent or a hole.

The toilet bowl ventilation system may include a housing affixed to a toilet seat. The housing includes at least one ventilation inlet positioned on a proximal end of the housing (i.e., end closer to the toilet tank or wall behind toilet) and a ventilation outlet. A fan is positioned within the housing and is operable to move air from the toilet bowl through an exhaust hose to an adjacent room or area (e.g., outdoors). In one embodiment, the fan is controlled by a controller which selectively provides power to the fan, and the fan moves air in response to receiving power from the controller. Aspects of the invention prevent a toilet user from being significantly exposed to the user's own odors, and prevent a subsequent user from being exposed to any odors from prior users.

Additional objects, features, and advantages of the invention will be apparent from the following detailed description when taken in conjunction with the accompanying drawings.

DETAILED DESCRIPTION OF THE INVENTION

While the making and using of various embodiments of the present invention are discussed in detail below, it should be appreciated that the present invention provides many applicable inventive concepts that is embodied in a wide variety of specific contexts. The specific embodiments discussed herein are merely illustrative of specific ways to make and use the invention and do not delimit the scope of the invention.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

Figure 1:
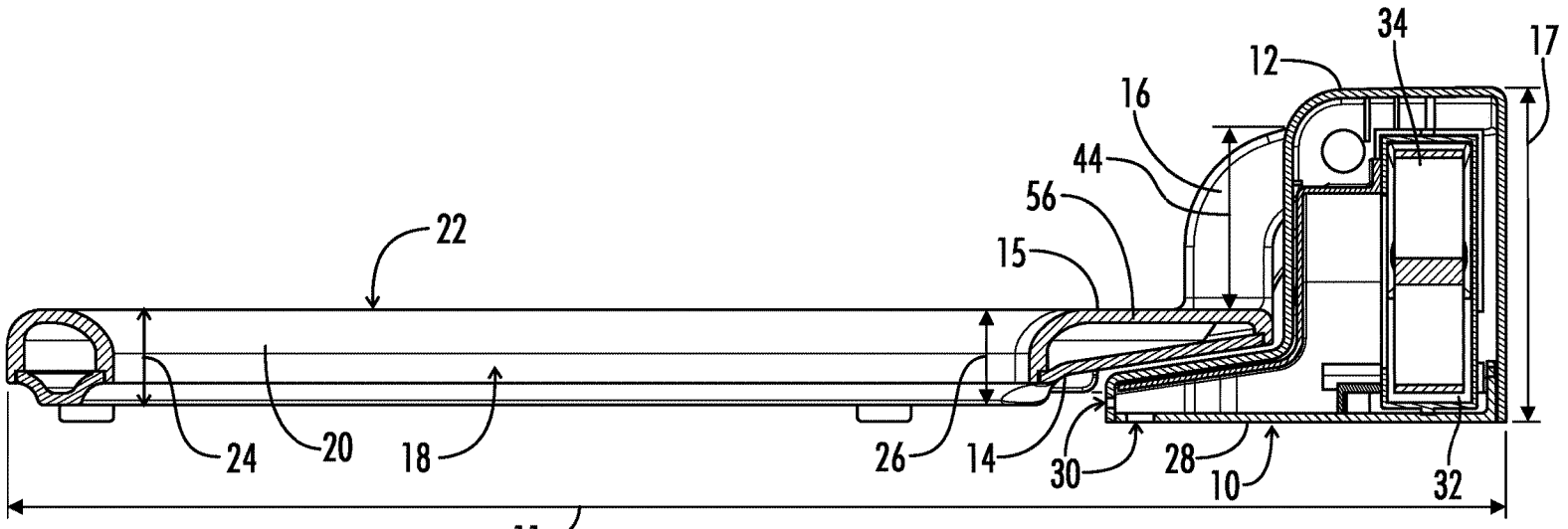
FIG. 1 is a side cross-sectional view of an embodiment of the toilet ventilation system.

A side view of an embodiment of a toilet ventilation system 10 is shown in FIG. 1. As shown in FIG. 1, a housing 12 is operably connected to a toilet seat 14. The toilet seat 14 is hinged to the housing 12. The toilet seat 14 may be selectively removable or fixedly attached. The toilet seat 14 may include a ventilation outlet 64 (FIGS. 5 and 6) which is integral with a seat hinge 16.

The housing 12 and the toilet seat 14 may be operably connected by, for example, forming the toilet seat 14 and the housing 12 with the hinge 16. In an embodiment, the toilet seat 14 and the housing 12 are attached with two hinges. The toilet seat 14 may have a hinge area 15. The hinge 16 may connect to the hinge area 15 and the housing 12. In an embodiment including multiple hinges 16, the hinges are spaced apart by a distance 25 (FIG. 3), which may be from about 5 mm to about 28 mm. The housing 12 and the toilet seat 14 may be mounted onto the distal end of a standard commercial or residential toilet bowl (not pictured). The toilet seat 14 may be round or elongated in shape. The toilet seat 14 includes an aperture 18 for the passage of waste from a user to the toilet bowl. The toilet seat 14 may include an aperture sidewall 20. In an embodiment, the aperture sidewall 20 does not include holes and/or vents. The aperture sidewall 20 may have one or more rounded edges. The aperture sidewall 20 may have an aperture sidewall height 23 of from about 25 mm to about 45 mm. The toilet seat 14 has a seat surface 22 that has a toilet seat distal height 24 and a toilet proximal height 26 that are about equal in the illustrated embodiment.

The hinge area 15 may have a hinge area length 88 of from about 30 mm to about 60 mm. The hinge area 15 may have a hinge area height 90 of from about 20 mm to about 40 mm.

The housing 12 may have a housing height 17 of from about 20 mm to about 200 mm. The toilet seat 14 may have a toilet seat length 9 of from about 350 mm to about 525 mm. The toilet seat 14 and the housing 12 may have a total combined length 11 of from about 400 mm to about 625 mm. The toilet seat 14 may have a toilet seat width 27 of from about 15 mm to about 35 mm. The aperture 18 may have an aperture length 19 of from about 250 mm to about 450 mm. The aperture 18 may have an aperture width 21 of from about 175 mm to about 275 mm. The housing 12 may be recessed from the toilet tank at a recessed distance (not shown) of from about 1 to about 10 mm.

Figure 9:
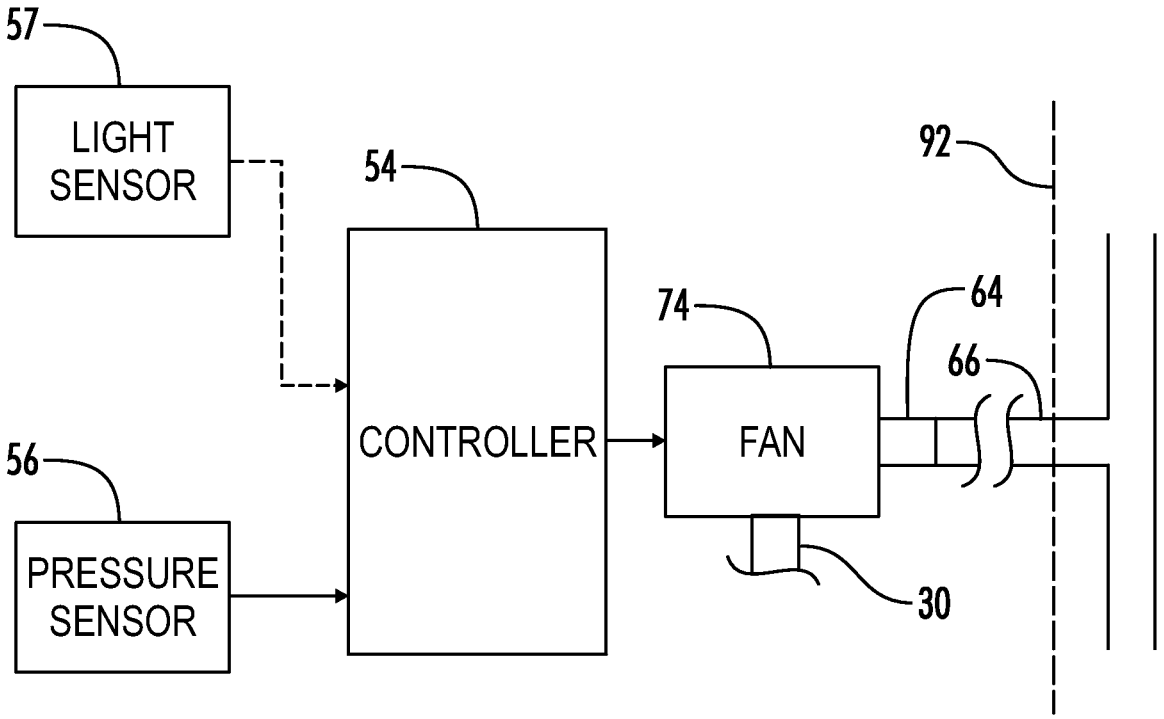
FIG. 9 is a block diagram of the control system.

The housing 12 includes a bottom surface 28. The bottom surface 28 includes at least one ventilation inlet 30. In an embodiment, the housing 12 may include an enclosure 32 and a housing passage 13. The enclosure 32 encloses a fan 34 for moving air from a toilet bowl area (not pictured) to the ventilation inlet 30 through the housing passage 13 and the enclosure 32 and into an adjacent area 92 (FIG. 9). The fan 34 may be positioned vertically, horizontally, or diagonally within the enclosure 32. The fan 34 may be, for example, a squirrel cage fan (FIG. 1) or a bladed fan (FIG. 2).

Figure 2:
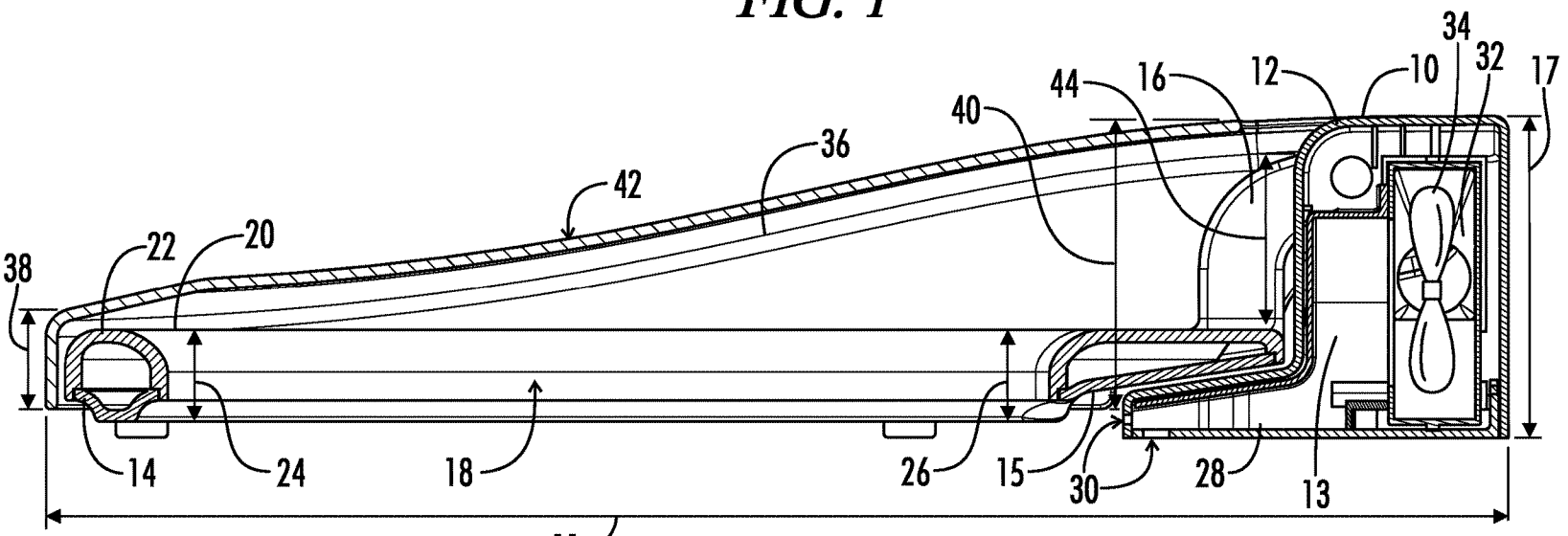
FIG. 2 is a side cross-sectional view of the embodiment of FIG. 1 with a cover over the toilet seat.

As shown in FIG. 2, the toilet ventilation system 10 may include a seat cover 36. The seat cover 36 may be round or elongated to match the toilet seat 14. The seat cover 36 may be operably attached to the housing 12, by, for example, the hinge(s) 16. The same hinge(s) 16 may attach the housing 12, the seat cover 36 and the toilet seat 14, or independent hinge(s) may attach the housing 12 and toilet seat 14, and the housing 12 and the seat cover 36. The hinge(s) 16, either individually or together, may incorporate a closing mechanism to control the descent and/or opening speed of the seat and lid between their respective open positions and closed positions. For example, the closing mechanism may modulate the speed of the toilet seat 14 and/or the seat cover 36 closing as to prevent slamming against a toilet bowl. Such closing mechanisms are known and are not described herein. Even if such a closing mechanism is not utilized, the fan 34 is in the housing and is not subject to wear from opening and closing toilet seat 14 and/or the seat cover 36.

In another embodiment, the seat cover 36 includes a distal seat cover height 38 and a proximal seat cover height 40. The proximal seat cover height 40 may be taller than the distal seat cover height 38 so that a seat cover top 42 upwardly tapers from distal side of the seat cover top 42 to the proximal side of the seat cover top 42. The proximal seat cover height 40 may be taller than a hinge height 44 so that seat cover 36 at least partially, or fully, covers the hinge(s) 16. The heights, shapes and length of seat cover 36 may be such that seat cover 36 covers all, or substantially all, of the toilet seat 14 and the hinge 16. Advantages of covering the toilet seat 14 and the hinge 16 include reducing surfaces which require cleaning and improving aesthetics.

Figure 3:
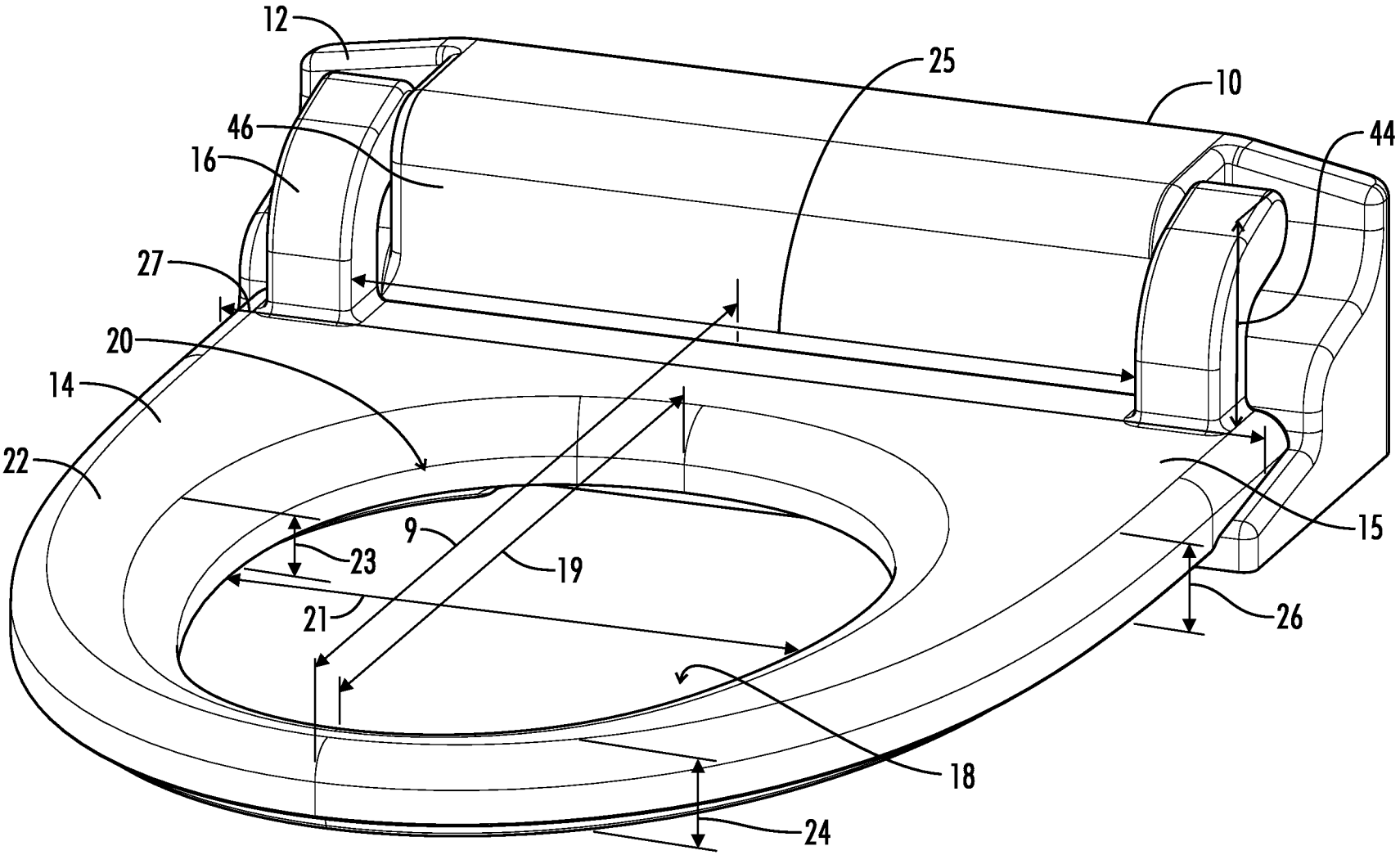
FIG. 3 is a top perspective view of the embodiment of FIG. 1.

As seen in FIG. 3, the housing 12 may include a rise 46. The toilet seat 14 and/or the seat cover 36 may be positioned above the rise 46 when in an open position (not shown).

Figure 4:
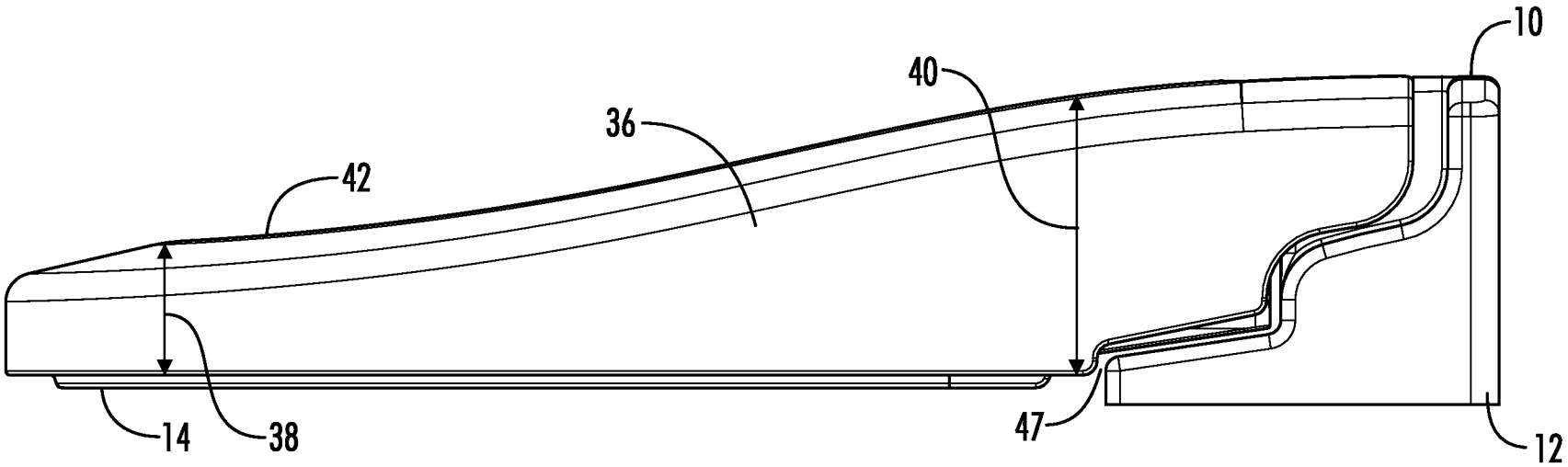
FIG. 4 is a side view of an embodiment of FIG. 1.

As seen in FIG. 4, a channel 47 may be formed between the housing 12, the toilet seat 14 and the seat cover 36.

Figure 5:
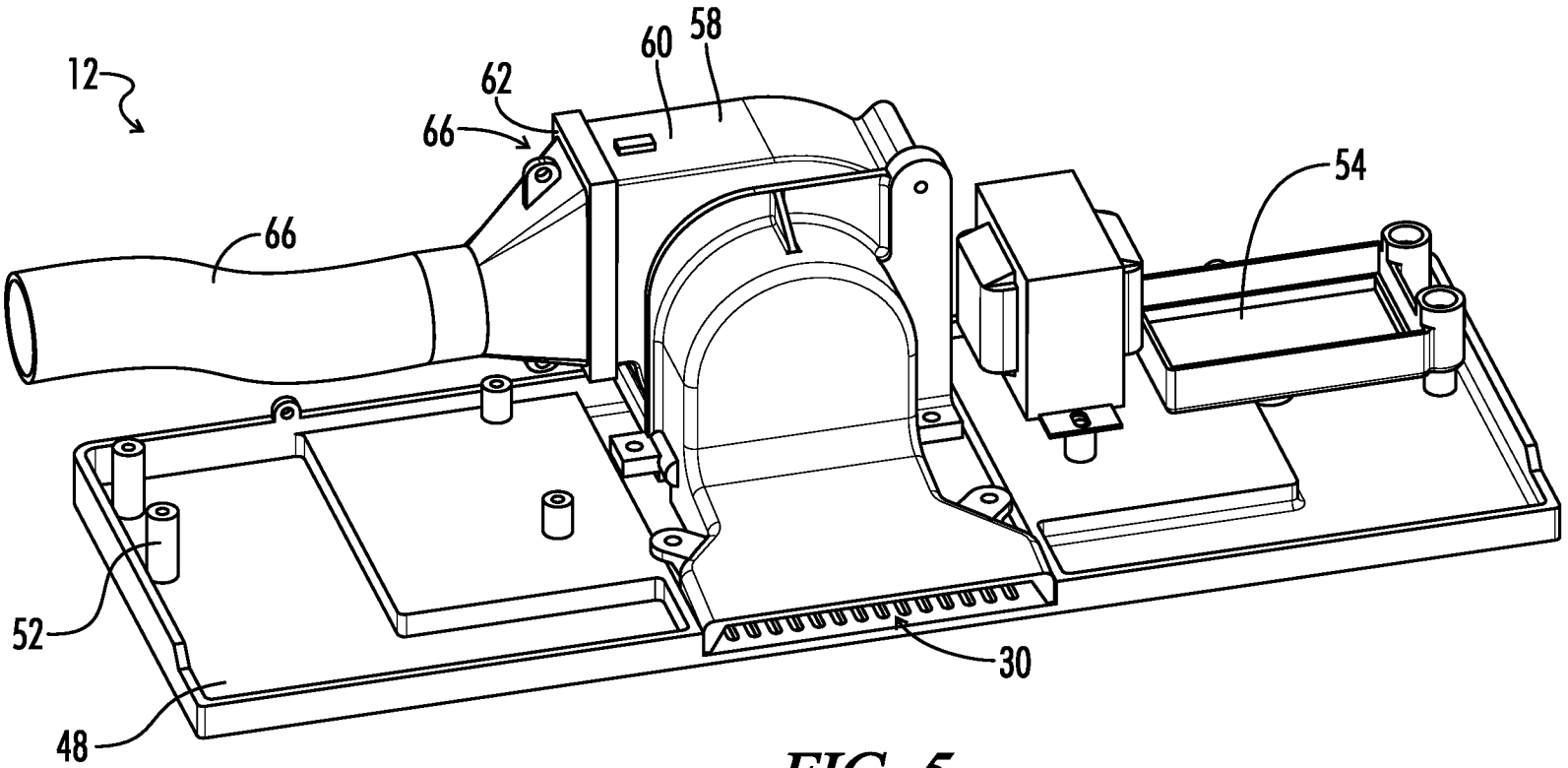
FIG. 5 is an internal view of the embodiment of FIG. 1.
Figure 6:
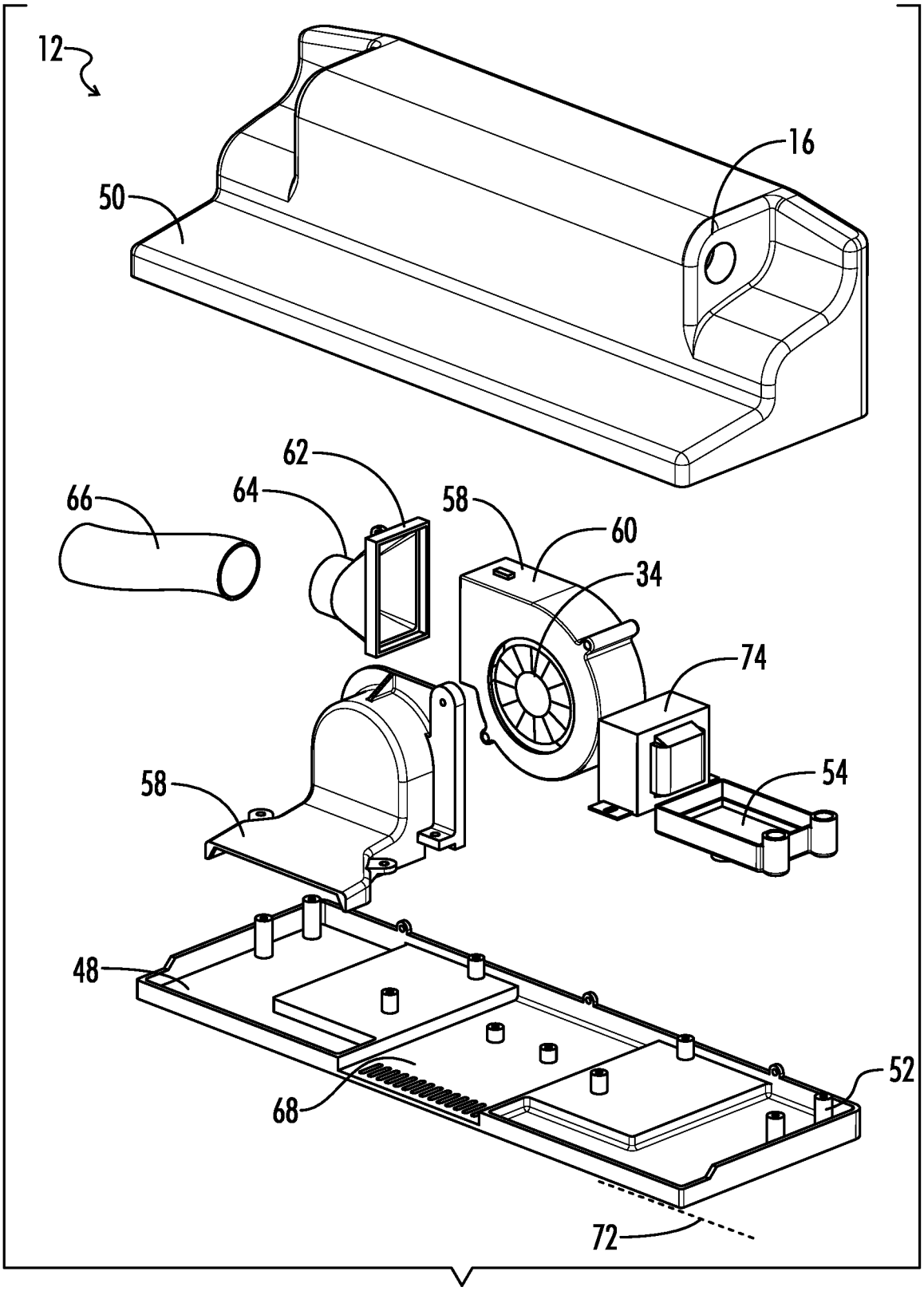
FIG. 6 is an exploded view of the embodiment of FIG. 5.

FIGS. 5 and 6 provide an internal view of the housing 12. The housing 12 includes a bottom housing platform 48 and a top housing platform 50 (FIG. 6), which may be selectively joined together, by, for example, at least one connection member 52. At least one connection member 52 may be, for example. a plurality of integrated tab members, magnetic members, hook and loop members, or a single continuous edge and corresponding overlapping lip. In some embodiments, the top housing platform 50 includes the hinge(s) 16 as an integrally attached member.

The housing 12 encloses a fan cover 58 positioned over the fan 34 (FIG. 1). The fan cover 58 includes a top surface 60 and at least one fan cover sidewall 62. The fan cover 58 further includes a ventilation outlet 64 (FIG. 6) operatively connecting the fan cover 58 to an exhaust hose 66. The ventilation outlet 64 is positioned above the fan 34 and within the at least one fan cover sidewall 62. Moreover, an inlet cover 68 may be positioned below the fan 34 so as to prevent water and foreign objects from striking the fan 34. The inlet cover 68 may include a plurality of solid members, a mesh structure, or a selectively removable solid cover (e.g. for cleaning). In an embodiment, the fan cover 58 also includes a recess for receiving a fan transformer 74 (FIG. 6).

Figure 8:
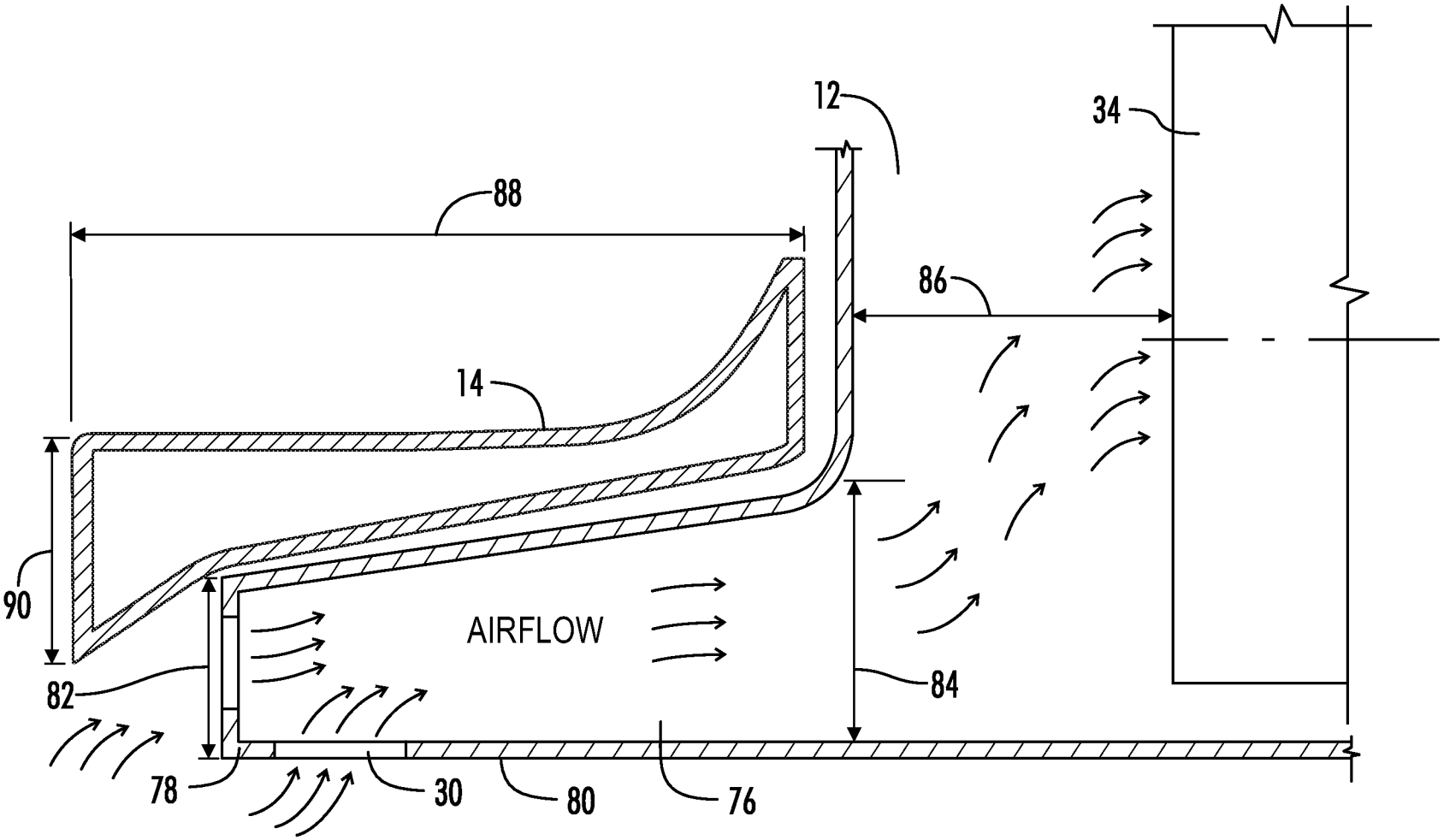
FIG. 8 is a schematic side view of another embodiment of the invention.

The adjacent area 92 may comprise an exhaust hose, tube and/or a pipe, as shown in FIG. 8. For example, an exhaust hose 66 may be rigid or flexible, and may be constructed of polymer or metallic materials, including, for example, PVC. The exhaust hose 66 hose may be connected to an existing bathroom ventilation system. The exhaust hose 66 may serve to transport air from the fan cover 58 to an adjacent room, area 92, or to further ventilate the air. In some embodiments, a system for ventilating the air from the exhaust hose 66 may include a length of flexible tubing (not shown) which may be extended to tailor the needs of the area in which it is installed, and/or to the secondary ventilation system to which it is attached, such as an existing bathroom ventilation system. Alternatively, the exhaust hose 66 may be a preselected solid piece of PVC pipe or other suitable material.

Figure 7:
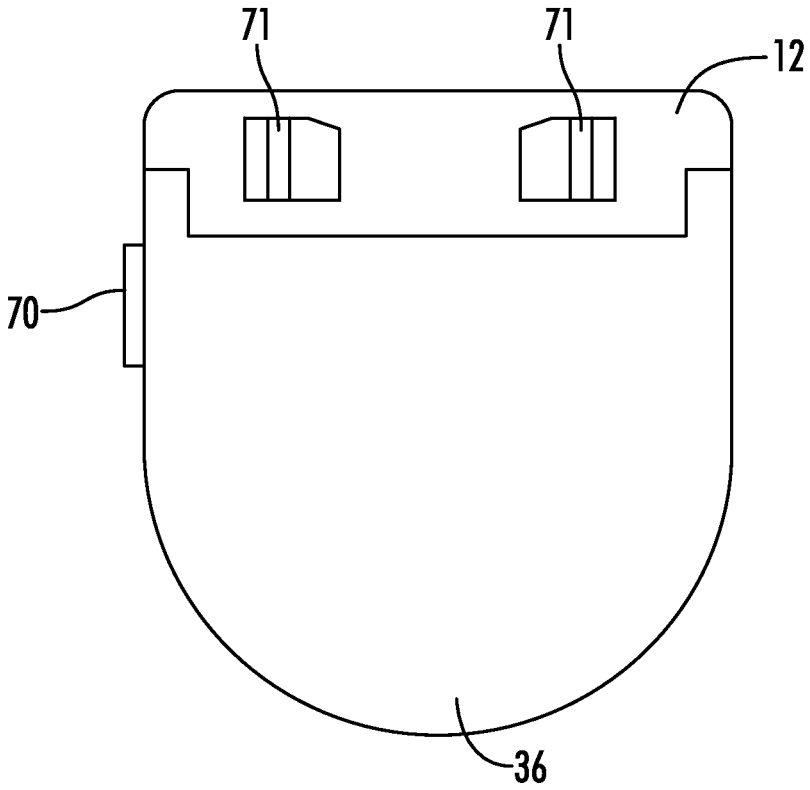
FIG. 7 is a top view of one embodiment of the invention.

As shown in FIG. 7, the housing 12 may include one or more mounting brackets 71, positioned near the distal end of the toilet bowl. In an another embodiment, the housing 12 may also be attached to the seat cover 36. One or more mounting brackets may be positioned and configured to be compatible with existing toilets, including a "universal" type design.

In some embodiments, the housing 12 may be integrally attached with a side member 70. The side member 70 may extend laterally outward and along a side of the toilet seat 14 or the housing 12 and serve as an extended area for containing the controller 54 (FIGS. 5 and 6) or any other element disposed within the housing 12 (e.g., the fan 34). Furthermore, the side member 70 may contain a filter element (e.g., activated charcoal). The side member 70 may serve as a selectively openable area for user storage.

As shown in FIG. 8, the housing 12 may include a lower distal vent portion 76. The lower distal vent portion 76 includes the at least one ventilation inlet 30. The at least one ventilation inlet 30 may be on a lower distal vent portion sidewall 78 and/or on a lower distal vent portion bottom surface 80 (as shown). The ventilation inlet 30 is positioned proximate to, or above, the toilet bowl. Air is drawn from the toilet bowl area through the housing 12 to the fan 34 and then discharged to the ventilation outlet 64 (not shown).

The lower distal vent portion sidewall 78 may have a lower distal vent portion sidewall height 82 of from about 10 mm to about 25 mm. The lower proximal vent portion 76 may have a lower proximal vent portion height 84 of from about 15 mm to about 35 mm. The housing 12 may have a fan distance 86 of from about 20 mm to about 40 mm.

Certain embodiments of the ventilation system 10 are mounted on the distal end of the toilet bowl such that the ventilation system 10 is adjacent the toilet tank or handle. Optionally, the ventilation system 10 may be configured such that the housing 12 mounts to the seat mounting holes of a standard commercial or residential toilet.

In some embodiments, the ventilation system 10 may include one, or a set of one or more, brackets which serve to attach the ventilation system 10 to the toilet bowl.

The controller 54 (FIGS. 5 and 6) may be included to regulate and selectively apply power to the fan 34. For example, in one embodiment, the controller 54 comprises a WT51F104microcontroller commercially available from Welltrend Semiconductor of Hsinchu, Taiwan. The controller 54 is responsive to inputs from the sensor 56 and from an optional light sensor 57 to generate pulse-width modulation (PWM) signals to control the rotational speed of the fan 34.

In some embodiments, the controller 54 may supply power to the fan 34 upon receiving a signal from the sensor 56 (FIG. 9) indicating that a body is seated on the toilet seat 12. The sensor 56 may be incorporated into, or on, the toilet seat 14, the housing 12 or the hinge(s) 16. The sensor 56 may detect when a user, or body, is sitting on the toilet seat 14 by, for example, a weight sensor or a motion sensor. In an embodiment, when a body sits on the toilet seat 14, the sensor 56 detects the presence of the sitting body and supplies power to the fan 34. The signal may either be continuous for the period during which a body is detected, or the signal may include a singular instant transmittal (i.e., a pulse). Upon receiving a signal, the controller 54 provides power to the fan 34 such that the fan 34 is automatically operated as soon as a user sits on the toilet seat 14. Furthermore, when the controller 54 no longer receives the sensor signal, it may immediately stop providing power to the fan 34. Alternatively, the controller 54 may continue to supply power to the fan 34 for a predetermined amount of time, said time beginning either when the signal is first sent or when the signal stops being sent (i.e., indicates that the body is no longer on the toilet seat 14). If a pressure sensor is used, the signal may only be transmitted if and when a predetermined pressure threshold is met. The controller 54 also may also modulate fan speed based on, for example, user preference or whether use is commercial or residential. For example, fan speed may be higher and/or longer duration for commercial uses to account for more frequent use.

Some embodiments may include the optional light sensor 57 (FIG. 9) operable to transmit a signal to the controller 54 either when a light is sensed, or when a light circuit is broken. The controller 54 may be configured to, therefore, supply power to the fan 34 upon receipt of a signal. The light sensor might serve to signal the controller 54 only when an ambient room light has been turned on, for instance, when a user turns on the restroom light. In this manner, power might be supplied to the fan 34 such that the fan 34 only operates when a user is making use of the restroom. In this way, the fan 34 is not activated when a user is out of the restroom. The controller 54 may also automatically discontinue supplying power after a predetermined amount of time, thus ensuring the fan 34 is not accidentally left on.

The controller 54 may also include a manually actuated keypad or switch for activating it. In some embodiments, activation of the fan 34 may be manually controlled. Certain embodiments may automatically activate the fan 34 based on a predetermined set of conditions such as one or more time intervals.

In another embodiment, the controller 54 includes an electric circuit board, integrated circuit board, microcontroller, or any programmable computer system well-known in the art.

Some embodiments may include a closing mechanism (e.g., gas piston, torsion spring, compression spring, electric motor, soft-close hinge, etc.) operable to control a speed at which the toilet seat 14 closes and/or opens. Such a closing mechanism would serve to prevent the toilet seat 14 from slamming and potentially damaging itself, the housing 12, or a user. In some embodiments, the controller 54 serves to activate the closing mechanism, either automatically, or based on user input. For instance, the lid mechanism might automatically close when a pressure sensor no longer detects a threshold pressure amount. Alternatively, the user might press a keypad button or lightly push on the seat surface 22 or top surface of the lid 60.

The power may be supplied to the fan 34 and/or the sensor 56 by general purpose alternating current or by at least one battery.

The fan 34 may be oriented on a plane 72 (FIG. 6) of the bottom housing platform 48. In an alternate embodiment, the fan 34 is perpendicular to the plane 72.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

All of the apparatuses and/or methods disclosed and claimed herein may be made and/or executed without undue experimentation in light of the present disclosure. While the apparatuses and methods of this invention have been described in terms of the embodiments included herein, it will be apparent to those of ordinary skill in the art that variations may be applied to the apparatuses and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful Toilet Ventilation System, it is not intended that such references be construed as limitations upon the scope of this invention except as set forth in the following claims.

What is claimed is:

1. A toilet bowl ventilation system, comprising:

a housing having a top housing platform, a bottom surface, and side walls defining an enclosed space, the housing attached to a toilet seat comprising a waste aperture, the toilet seat having a lower surface and configured to be associated with a toilet bowl, the housing including a ventilation inlet in the bottom wall of the housing, and a ventilation outlet;

a fan positioned within the enclosed space, the fan operable to move air from the ventilation inlet through the housing to the ventilation outlet in response to receiving power;

a controller for selectively providing power to the fan; and wherein the top housing platform includes an upper surface shaped complementary to the lower surface of the toilet seat at a hinge area of the toilet seat, and wherein the upper surface and the lower surface of the toilet seat define a channel extending along a toilet seat width, and wherein the channel is proximate to the hinge area and in gaseous communication with the ventilation inlet.

2. A toilet bowl ventilation system of claim 1, wherein the housing further comprises a lower distal vent portion including at least one ventilation inlet.

3. The toilet bowl ventilation system of claim 1, further comprising an exhaust hose operable to fluidly connect the ventilation outlet of the housing to an adjacent area.

4. The toilet bowl ventilation system of claim 1, further comprising a closing mechanism operable to control a speed at which the toilet seat travels towards a rim of the toilet bowl when transitioning the toilet seat from an open position to a closed position.

5. The toilet bowl ventilation system of claim 1, further comprising:

a sensor positioned in the toilet seat, the sensor operable to provide an activation signal to the controller indicative of a presence of a body on the toilet seat, wherein the controller is operable to provide power to the fan when the activation signal indicates that the body is present on the toilet seat.

6. The toilet ventilation system of claim 1, further comprising:

a fan cover operable to at least partially enclose the fan, wherein the fan cover comprises a top and a sidewall;

a fan outlet positioned in the fan cover sidewall; and an inlet cover positioned underneath the fan, wherein the inlet cover is configured to prevent water from being pulled into the fan when the fan is receiving power from the controller.

7. The toilet ventilation system of claim 6, wherein the fan cover fully encloses the fan.

8. The toilet ventilation system of claim 1, wherein the ventilation outlet comprises an exhaust tube or an exhaust pipe.

9. The toilet ventilation system of claim 1, further comprising a seat cover hingedly attached to the housing and the toilet seat.

10. The toilet ventilation system of claim 9, wherein the seat cover has a distal seat cover height and a proximal seat cover height, and wherein the proximal height is greater than the distal height.

11. The toilet ventilation system of claim 9, wherein the toilet cover includes an upwardly tapered seat cover top.

12. The toilet ventilation system of claim 1, wherein the toilet seat includes an aperture sidewall and a bottom surface, and neither the aperture sidewall nor the bottom surface include a vent or a hole.

13. A ventilated toilet seat base, comprising:

a toilet seat including a waste aperture and a lower surface;

a base having a top housing platform, a bottom surface, and side walls defining an enclosed space, the base hingedly connected to the toilet seat, the base including a lower distal vent portion and configured to be received on a toilet;

an exhaust fan at least partially enclosed in the base, the exhaust fan in fluid communication with the lower distal vent portion and configured to draw air from the lower distal vent portion to the exhaust fan;

an outlet in fluid communication with the exhaust fan and configured to receive air from the exhaust fan; and a controller for selectively providing power to the fan;

wherein the top housing platform includes an upper surface shaped complementary to the lower surface of the toilet seat at a hinge area of the toilet seat, wherein the upper surface and the lower surface of the toilet seat define a channel disposed above the upper surface and below the lower surface of the toilet seat, and extending along a toilet seat width, and wherein the channel is proximate to the hinge area and in gaseous communication with the ventilation inlet.

14. The ventilated toilet seat base of claim 13, wherein the lower distal vent portion comprises at least one ventilation inlet.

15. The ventilated toilet seat base of claim 13, further comprising a fan cover at least partially enclosing the exhaust, the fan cover including a sidewall and a top;

a fan outlet positioned in the fan cover sidewall; and an inlet cover positioned underneath the fan, wherein the inlet cover is configured to prevent water from being pulled into the fan when the fan is receiving power from the controller.

16. The ventilated toilet seat base of claim 15, wherein the fan cover fully encloses the fan.

17. The ventilated toilet seat base of claim 13, further comprising a hose or a tube in fluid communication with the outlet and configured to receive air from the outlet.

18. The ventilated toilet seat base of claim 13, further comprising a seat cover positioned on the toilet seat, the seat cover hingedly attached to the base.

19. The ventilated toilet seat base of claim 13, wherein the toilet seat includes an aperture sidewall and a bottom surface, and neither the aperture sidewall nor the bottom surface include a vent or a hole.

20. The ventilated toilet seat base of claim 13, further comprising:

a sensor positioned in the toilet seat, said sensor operable to provide an activation signal to the controller indicative of a presence of a body on the toilet seat, wherein the controller is operable to provide power to the fan when the activation signal indicates that the body is present on the toilet seat.

* * * * *